US009074559B2

(12) United States Patent
Nemitallah et al.

(10) Patent No.: US 9,074,559 B2
(45) Date of Patent: Jul. 7, 2015

(54) ENGINE EMISSIONS CONTROL SYSTEM USING ION TRANSPORT MEMBRANE

(71) Applicant: KING FAHD UNIVERSITY OF PETROLEUM AND MINERALS, Dhahran (SA)

(72) Inventors: Medhat Ahmed Nemitallah, Dhahran (SA); Mohamed Abdel-Aziz Habib, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 25 days.

(21) Appl. No.: 14/072,760

(22) Filed: Nov. 5, 2013

(65) Prior Publication Data

US 2015/0121849 A1 May 7, 2015

(51) Int. Cl.
*F02M 25/06* (2006.01)
*F02M 25/07* (2006.01)

(52) U.S. Cl.
CPC ..... *F02M 25/074* (2013.01); *F02M 25/0718* (2013.01); *F02M 25/06* (2013.01); *F02M 25/072* (2013.01)

(58) Field of Classification Search
CPC ..... F02M 25/074
USPC ..... 60/278, 279
See application file for complete search history.

(56) References Cited

U.S. PATENT DOCUMENTS

| | | | | |
|---|---|---|---|---|
| 5,649,517 | A | 7/1997 | Poola et al. | |
| 6,516,787 | B1 | 2/2003 | Dutart et al. | |
| 6,892,531 | B2 * | 5/2005 | Rim | 60/295 |
| 6,964,158 | B2 * | 11/2005 | Abdul-Khalek | 60/278 |
| 7,337,770 | B2 | 3/2008 | Moon | |
| 7,661,262 | B2 * | 2/2010 | Bayerle et al. | 60/277 |
| 8,151,553 | B1 * | 4/2012 | Schechter | 60/279 |

FOREIGN PATENT DOCUMENTS

| | | |
|---|---|---|
| GB | 2345866 | 7/2000 |
| JP | 2009-270435 | * 11/2009 |

* cited by examiner

*Primary Examiner* — Thomas Denion
*Assistant Examiner* — Diem Tran
(74) *Attorney, Agent, or Firm* — Richard C Litman

(57) ABSTRACT

The engine emissions control system using an ion transport membrane incorporates an ion transport membrane unit into a closed, recirculating intake and exhaust system in the engine. The unit has a housing defining an air intake channel separated from an exhaust gas recirculation channel by an ion transport membrane. The membrane is permeable to oxygen, but is impermeable to nitrogen, water and carbon dioxide. Oxygen drawn from ambient air in the air intake channel is transported through the membrane to enrich the flow of exhaust gases in the exhaust gas recirculation channel, which is transported through a conduit to the engine intake for combustion of hydrocarbon fuel. The oxygenated exhaust gases may include uncombusted fuel or incomplete combustion products. Exhaust and intake accumulators may smooth the gas pulses. The accumulated or excess carbon dioxide and water in the exhaust is recovered from the system into onboard storage tanks or containers.

8 Claims, 2 Drawing Sheets

ENGINE EMISSIONS CONTROL SYSTEM USING ION TRANSPORT MEMBRANE

BACKGROUND OF THE INVENTION

1. Field of the Invention

The present invention relates generally to systems for the control and reduction of exhaust gas emissions in internal combustion engines, and particularly to an engine emissions control system using an ion transport membrane in a closed circuit intake and exhaust system.

2. Description of the Related Art

Advancing technology and improvements in the economies of many areas of the world have led to ever greater automation throughout the world. This has resulted in the increasing use of various fossil fuels, e.g., gasoline and diesel, etc. It has been recognized for some time that the combustion byproducts of these fuels, particularly carbon dioxide ($CO_2$), tend to produce a "greenhouse effect," i.e., to trap heat in the atmosphere and consequently raise the average worldwide temperatures, resulting in adverse effects upon the environment.

Accordingly, carbon capture from point source emissions, e.g., automotive exhausts, has been recognized as one of several strategies for mitigating the unfettered release of such "greenhouse gases" (GHGs), such as $CO_2$, into the atmosphere. To keep GHGs at manageable levels, large reductions in $CO_2$ emissions through capturing and separation of such gases will be required. World population growth and consequent rise in pollution and GHG emissions are some of the most important problems that the scientific community must solve in the near future. The energy production from fossil fuel sources represents more than 65% of GHG emissions ($CO_2$, methane or $CH_4$, and nitrogen oxide or $N_2O$) due to global human activity. Most scientists agree that there is a strong connection between climate change and the anthropogenic emissions of GHGs, of which $CO_2$ is by far the most important gas in terms of the amount emitted. Carbon dioxide is the major atmospheric contaminant leading to a temperature increase due to the greenhouse effect. The scientific community considers the reduction of anthropogenic $CO_2$ emission necessary to the maintenance of the existing world climate condition. As a result, radical changes in energy technologies based upon fossil fuel consumption, are needed.

Thus, an engine emissions control system using an ion transport membrane solving the aforementioned problems is desired.

SUMMARY OF THE INVENTION

The engine emissions control system using an ion transport membrane places the membrane between an ambient air source and the closed intake and exhaust system of the engine. Engine exhaust passes along the permeate side of the membrane. Oxygen from the ambient air flows from the feed side through the membrane to the permeate side, where it mixes with the previously combusted exhaust gases, primarily comprising carbon dioxide ($CO_2$) and water ($H_2O$). The oxygen-enriched exhaust gases then recirculate back to the intake side of the engine, where the oxygen combines with fresh hydrocarbon fuel for combustion.

Preferably, the exhaust gases pass through an accumulator or plenum immediately after leaving the engine in order to smooth the exhaust pulses from the reciprocating engine operation. This also allows the exhaust gases to cool to a temperature that is suitable for passage along the side of the ion transport membrane without damaging the membrane, while still retaining sufficiently high temperatures for optimum operation of the membrane. An intake accumulator or plenum may also be provided immediately upstream of the intake side of the engine.

It will be seen that the above-described system will accumulate combustion products, primarily comprising $CO_2$ and $H_2O$, in the closed intake and exhaust system, i.e., on the permeate side of the ion transport membrane. Accordingly, an excess portion of these gases may be recovered from the system for other use or disposal. The water is easily cooled to its liquid state for use in cooling the engine or for storage in an onboard tank or container for later use or disposal. The carbon dioxide may also be recovered using conventional means for other use, or appropriate environmentally sound disposal.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
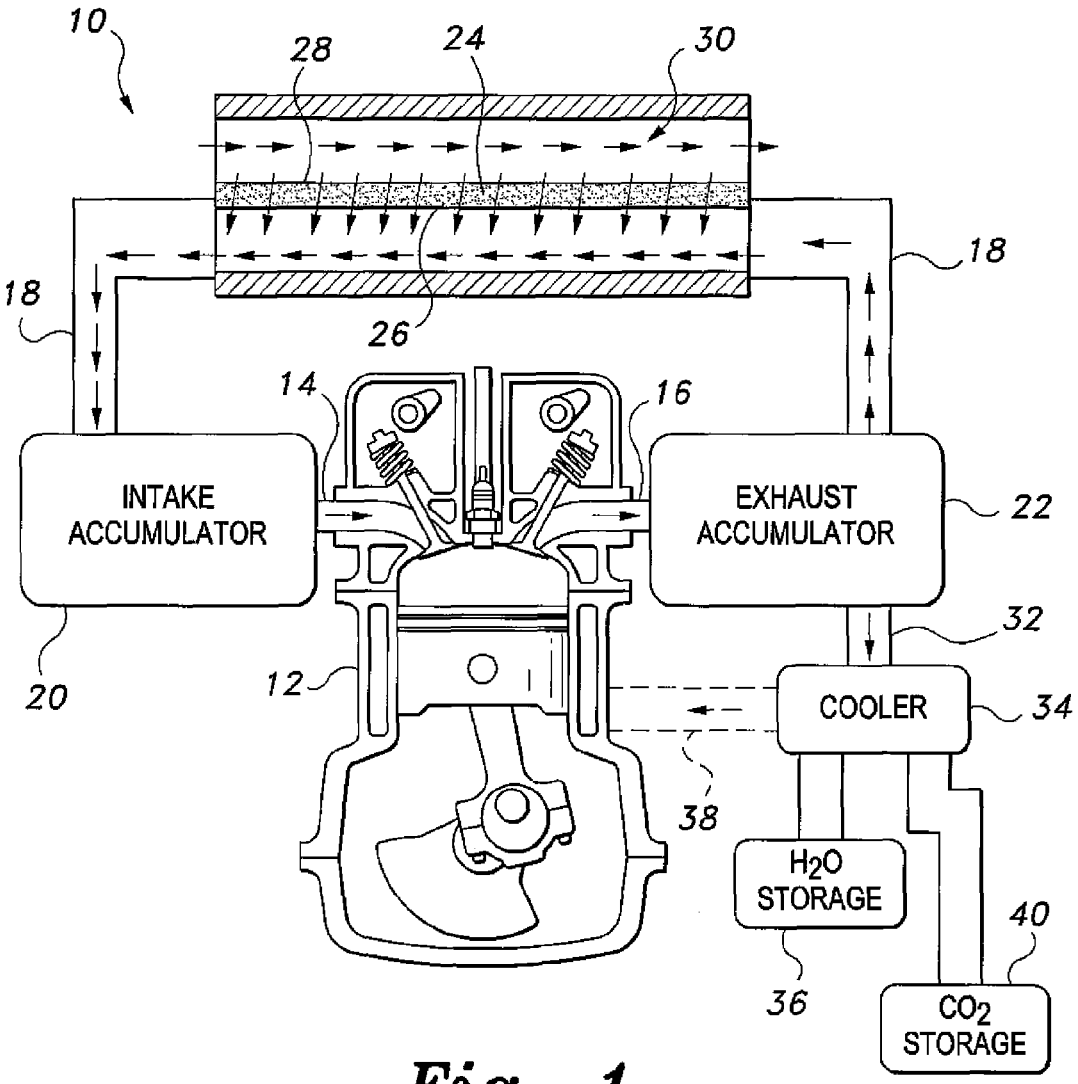
FIG. 1 is a schematic elevation view of an engine emissions control system using an ion transport membrane according to the present invention, illustrating its general configuration.

The engine emissions control system using an ion transport membrane (the system is designated generally as 10 in the drawings) serves to retain all engine exhaust emissions in a closed loop intake and exhaust system, enriching the circulating gases with oxygen that passes through the membrane. Accumulated exhaust gases are cooled and retained in onboard storage containers or tanks for later use or disposal.

FIG. 1 of the drawings provides a schematic elevation view of a reciprocating internal combustion engine incorporating the emissions control system 10. While the engine 12 is illustrated with double overhead cams, a water cooling jacket, and other features specific to certain engine configurations, it should be understood that the engine 12 represented in FIG. 1 is exemplary, and that the engine may be any type of reciprocating internal combustion engine, e.g., Otto cycle or spark ignition, diesel or compression ignition, etc.

The engine 12 includes an intake side or inlet 14 and an exhaust side or outlet 16. The engine 12 also includes conduits 18 that connect the inlet 14 and the outlet 16 to one another, i.e., intake air is not drawn directly from the atmosphere and exhaust gases are not emitted back into the atmosphere. Rather, the gases are continuously recirculated from the exhaust side or outlet 16 of the engine through the conduits 18 and back to the intake side or inlet 14 in a closed loop, so that selected gases may be removed from the system for onboard storage and later use or disposal as described further below.

The intake and exhaust system may further include an intake plenum or accumulator 20 disposed between the conduit 18 and the intake or inlet 14, and an exhaust plenum or accumulator 22 disposed between the exhaust or outlet 16 and the conduit 18. The gases circulating through the engine 12 and the conduits 18 pass through the two accumulators or plenums 20 and 22, which serve to smooth out gas pulses produced by the intermittent combustion portion of the reciprocating engine operation cycle. This produces more even flow through the conduits 18 to optimize operation, as described further below.

The system 10 includes an ion transport membrane unit having a housing defining an air intake channel 30 separated from an exhaust gas recirculation channel by an ion transport membrane 24. The ion transport membrane 24 is installed in-between the conduits 18 between the intake side 14 and the exhaust side 16 of the engine 12. The membrane is permeable to oxygen, but is impermeable to nitrogen, water and carbon dioxide. The membrane 24 includes a permeate side 26 in fluid communication with the exhaust gases flowing through the conduits 18, and a feed side 28 on the air intake channel side of the membrane 24. The air intake channel 30 communicates fluidly with the feed side 28 of the membrane 24, providing ambient air flow serving as a source of oxygen to the feed side 28 of the membrane 24. As air flows through the air intake channel 30, oxygen is selectively extracted from the air (assisted by the partial pressure difference) through the ion transport membrane 24 to the permeate side 26, and the oxygen-depleted air either escapes to the atmosphere, or is collected at the outlet of the air intake channel for use in applications where a nitrogen-enriched atmosphere is useful, e.g., manufacture of fertilizers.

Oxygen is selectively transported from the ambient air flowing through the passage 30 through the feed side 28 to the permeate side 26 of the membrane 18, where it flows into the exhaust gas recirculation channel. This oxygenated gas then flows into the intake side 14 of the engine 12 via the intake accumulator or plenum 20, and into the combustion chamber, where the oxygen combusts with the hydrocarbon fuel therein to produce power. The exhaust gas, consisting primarily of water vapor ($H_2O$) and carbon dioxide ($CO_2$), but also including any uncombusted fuel or incomplete combustion products, then passes from the combustion chamber and back into the conduits 18 via the exhaust accumulator or plenum 22 for passage through the exhaust gas recirculation channel along the permeate side 26 of the ion transport membrane 24 to receive more oxygen.

It will be seen that the exhaust gases will continue to accumulate within the conduits 18 as engine operation continues, unless some means is provided to remove excess exhaust gases. Accordingly, an accumulator outlet 32 extends from the exhaust accumulator or plenum 22 to route excess accumulated exhaust gases from the system 10. The outlet 32 extends to a cooler 34, where the water and carbon dioxide vapors or gases are cooled using conventional means, e.g., heat exchangers, refrigeration, etc. The water vapor condenses to a liquid and flows to a storage tank or container 36 onboard the vehicle on which the system 10 is installed. Alternatively, the liquid water may be used to replenish the cooling system of the engine 12 through an alternative delivery line 38. The carbon dioxide remains as a gas at the temperatures of liquid water, and passes to an onboard carbon dioxide storage tank or container 40. The gaseous carbon dioxide may be compressed by conventional means for compact storage, and/or refrigerated further for storage in solid form. The accumulated water and carbon dioxide are recovered periodically for other use or disposal.

Figure 2:
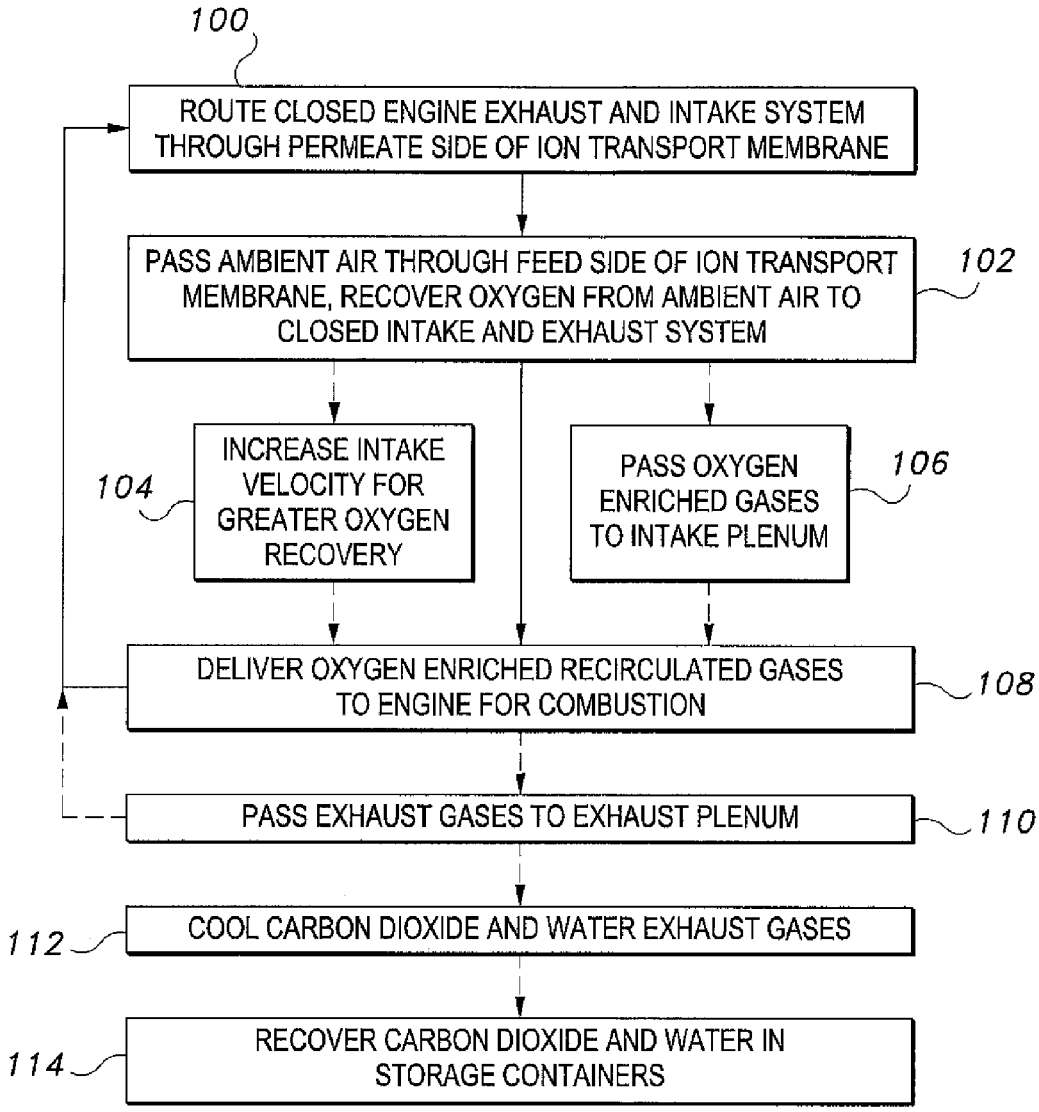
FIG. 2 is a flowchart briefly describing the basic steps in the method of operation of the engine emissions control system using an ion transport membrane according to the present invention.

FIG. 2 is a flowchart that briefly describes the basic steps in the operation of the engine emissions control system using an ion transport membrane according to the present invention. The operation of an internal combustion engine results in exhaust byproducts, primarily consisting of $H_2O$ (water) and $CO_2$ (carbon dioxide), as hydrocarbon fuel is oxidized by oxygen from the ambient air. Rather than passing these exhaust byproducts back into the ambient air, the system 10 routes these exhaust gases back through the engine in a continuous closed loop through the closed intake and exhaust system and ion transport membrane, as explained further above and as described briefly in step 100 of FIG. 2.

As ambient air is passed through or over the feed side of the membrane, pure oxygen is recovered from the ambient air to pass through the membrane and out the permeate side of the membrane. The permeate side of the membrane forms a portion of the closed intake and exhaust system of the engine so that the recovered oxygen passes into the closed circulation of the intake and exhaust system, generally as indicated in the second step 102 of the flowchart of FIG. 2. Increased efficiency may be achieved by increasing the velocity of the ambient airflow past the membrane, e.g., by increasing the speed of the vehicle on which the system is installed and orienting the intake system toward the front of the vehicle, or by means of supercharging or otherwise increasing the airflow, generally as indicated by the optional third step 104 of FIG. 2. An intake plenum or accumulator may be included in the system to smooth the inherent pulses of gas flowing through the closed intake and exhaust system due to the reciprocating operating cycle of the engine, as indicated by the optional fourth step 106 of FIG. 2.

The oxygen-enriched gases continue to flow back through the closed system to the intake side of the engine, where they pass into the combustion chamber, and the added oxygen undergoes combustion with the hydrocarbon fuel, generally as indicated by the fifth step 108 of FIG. 2. The burned fuel comprising exhaust gases passes out the exhaust side of the engine and back into the closed engine exhaust and intake system, where it passes the permeate side of the ion transport membrane to pick up more oxygen. Thus, the basic cycle returns to the first step 100 of the flowchart of FIG. 2. An exhaust plenum or accumulator may be provided, so that a portion of excess exhaust gas passes through the exhaust plenum to smooth the pressure pulses from the intermittent combustion events, as indicated by the optional sixth step 110 of FIG. 2.

Rather than routing the accumulated excess exhaust gases back into the atmosphere, the present system provides for the capture of these gases, generally as indicated by the final two steps of the flowchart of FIG. 2. It will be seen that the gases flowing through the closed system will be relatively hot due to the combustion process within the engine combustion chamber(s). This heat is beneficial to the operation of the ion transport membrane, as some amount of heat serves to increase the efficiency of the transport process across the membrane. However, excessive heat may damage the membrane. Some form of heat exchanger or the like may be provided to maintain close to optimum temperature for the gases as they pass through the membrane.

In any event, the relatively warm gases, consisting primarily of $H_2O$ and $CO_2$, will be in a gaseous state. In order to recover these gases efficiently, it is necessary to cool them, as provided by the seventh step 112 of the flowchart of FIG. 2. This process naturally separates the water and carbon dioxide respectively into liquid and gaseous phases, where they are readily separable. The liquid water flows to a water storage container for storage and periodic recovery as desired. The gaseous carbon dioxide is further condensed for compact storage using any known means, e.g., compression or refrigeration to a solid state. This recovery and storage of the water and carbon dioxide is indicated by the final eighth step 114 of the flowchart of FIG. 2.

Accordingly, the engine emissions control system using an ion transport membrane provides a closed system in which no exhaust emissions whatsoever are emitted to the atmosphere. This system thus comprises a truly zero emissions system, with exhaust byproducts being captured on board in storage tanks or containers for periodic disposal, or for other use where possible. The water may be used to replenish water lost from a liquid cooling system for the engine, or may be returned to the environment. The carbon dioxide may be used in a large number of various industrial applications, or may be disposed of through deep burial or broken down into its constituent elements using a clean power source, such as solar power, wind power, etc.

It is to be understood that the present invention is not limited to the embodiments described above, but encompasses any and all embodiments within the scope of the following claims.

We claim:

1. In an internal combustion engine, an engine emissions control system using an ion transport membrane, the system comprising:

an ion transport membrane unit having a housing defining an air intake channel and an exhaust gas recirculation channel, the unit having an ion transport membrane dividing the air intake channel from the exhaust gas recirculation channel, the membrane being selectively permeable to oxygen to permit oxygen from ambient air to pass through the membrane from the air intake channel to the exhaust gas recirculation channel, said ion transport membrane unit being impermeable to nitrogen, water and carbon dioxide;

a first conduit extending from the exhaust gas recirculation channel and adapted for connection to an intake of the engine;

a second conduit extending from the exhaust gas recirculation channel and adapted for connection to an exhaust of the engine; and means for disposing of accumulated excess exhaust gases in the conduits;

whereby, oxygen extracted from the ambient air passing through the air intake channel is selectively transported through the membrane to enrich exhaust gases passing through the exhaust gas recirculation channel to provide oxygen-enriched exhaust gases to the intake of the engine.

2. The engine emissions control system using an ion transport membrane according to claim 1, further comprising the internal combustion engine in combination therewith.

3. The engine emissions control system using an ion transport membrane according to claim 1, further comprising:

an intake accumulator disposed between the first conduit and the intake of the engine; and an exhaust accumulator disposed between the second conduit and the exhaust of the engine, the first and second conduits and the exhaust gas recirculation channel providing fluid communication between the accumulators.

4. The engine emissions control system using an ion transport membrane according to claim 3, wherein said means for disposing of accumulated excess exhaust gases comprises:

an exhaust gas cooler communicating fluidly with the exhaust accumulator;

a water processing and storage system communicating fluidly with the exhaust gas cooler; and a carbon dioxide processing and storage system communicating fluidly with the exhaust gas cooler.

5. A method of reducing the exhaust emissions of an internal combustion engine using the apparatus of claim 1, comprising the steps of:

(a) operating the engine, thereby producing a flow of exhaust gases in the intake and exhaust manifold;

(b) enriching the exhaust gases with oxygen extracted from ambient air and transported from the air intake channel through the ion transport membrane to the exhaust gas recirculation channel of the ion transport membrane unit to flow into the conduit connected to the engine intake;

(c) supplying hydrocarbon fuel to the engine;

(d) burning the fuel in the engine using the oxygen-enriched exhaust gases; and (e) disposing of excess byproducts in the conduits.

6. The method of reducing the exhaust emissions of an internal combustion engine according to claim 5, further comprising the steps of:

(a) providing an intake accumulator communicating fluidly with the intake of the engine;

(b) providing an exhaust accumulator communicating fluidly with the exhaust of the engine; and (c) smoothing the reciprocating pulses of exhaust and intake gases by passing the gases through the exhaust and intake accumulators, respectively.

7. The method of reducing the exhaust emissions of an internal combustion engine according to claim 6, further comprising the steps of:

(a) providing an exhaust gas cooler communicating fluidly with the exhaust accumulator;

(b) passing the water and carbon dioxide exhaust gas emissions through the cooler, thereby cooling the emissions;

(c) providing a water processing and storage system communicating fluidly with the exhaust gas cooler;

(d) processing and storing the cooled water in the water processing and storage system;

(e) providing a carbon dioxide processing and storage system communicating fluidly with the exhaust gas cooler; and (f) processing and storing the cooled carbon dioxide in the carbon dioxide processing and storage system.

8. The method of reducing the exhaust emissions of an internal combustion engine according to claim 5, further comprising the steps of:

(a) increasing the velocity of the airflow through the air intake channel, thereby increasing the amount of oxygen passing through the membrane to the exhaust gas recirculation channel; and (b) increasing the efficiency of the membrane by heating the membrane with exhaust gases as the exhaust gases flow in the exhaust gas recirculation channel alongside the membrane.

* * * * *